United States Patent [19]

Brandstetter

[11] Patent Number: 5,012,665

[45] Date of Patent: May 7, 1991

[54] PRESS INSTALLATION HAVING SEVERAL PRESSES FOR THE WORKING OF SHEET-METAL PARTS

[75] Inventor: Rudi Brandstetter, Adelberg, Fed. Rep. of Germany

[73] Assignee: L. Schuler GmbH, Fed. Rep. of Germany

[21] Appl. No.: 428,587

[22] Filed: Oct. 30, 1989

[30] Foreign Application Priority Data

Feb. 18, 1989 [DE] Fed. Rep. of Germany ..... 3905069

[51] Int. Cl.[5] ..... B21D 43/05

[52] U.S. Cl. ..... 72/405

[58] Field of Search ..... 72/405, 421; 198/621

[56] References Cited

U.S. PATENT DOCUMENTS

| | | | |
|---|---|---|---|
| 3,434,328 | 3/1969 | Taniguchi | 72/405 |
| 3,875,808 | 4/1975 | Okamoto et al. | 74/29 |
| 4,139,090 | 2/1979 | Nelsen | 198/621 |
| 4,557,134 | 12/1985 | Kuppinger | 72/405 |
| 4,625,540 | 12/1986 | Yamada et al. | 72/405 |
| 4,741,195 | 5/1988 | Arai | 72/405 |

FOREIGN PATENT DOCUMENTS

| | | | |
|---|---|---|---|
| 1271067 | 2/1969 | Fed. Rep. of Germany . | |
| 2625881 | 12/1976 | Fed. Rep. of Germany . | |
| 2657911 | 12/1976 | Fed. Rep. of Germany . | |
| 2726289 | 6/1977 | Fed. Rep. of Germany . | |
| 3246096 | 12/1982 | Fed. Rep. of Germany . | |
| 155110 | 7/1986 | Japan | 72/405 |
| 945264 | 12/1963 | United Kingdom . | |
| 1321846 | 7/1973 | United Kingdom | 72/405 |
| 2199781 | 7/1988 | United Kingdom . | |

*Primary Examiner*—Daniel C. Crane

*Attorney, Agent, or Firm*—Evenson, Wands, Edwards, Lenahan & McKeown

[57] ABSTRACT

A hybrid press installation employs a plurality of individual presses including a drawing press and transfer presses. These presses, by means of frames, are set up on common installation surfaces. A tool is assigned to each press which includes a head piece, a slide and a press bed and a sliding table. The tools can be exchanged by means of the sliding tables. A transfer device extends through the hydrid press installation, the components of this transfer device being arranged above the sheet metal conveying plane, and gripping the sheet metal parts from above. Intermediate depositing devices are positioned between two working stages. As a result, a reduction of the length of the transfer movement of the sheet metal parts per slide stroke is achieved. In this manner, large-surface and/or thin-walled and therefore unstable sheet metal parts can be transferred.

18 Claims, 7 Drawing Sheets

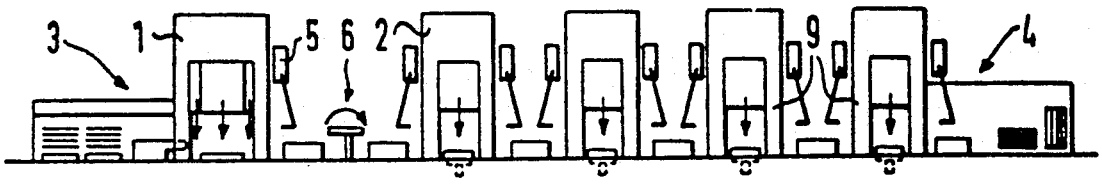
FIG. 1A
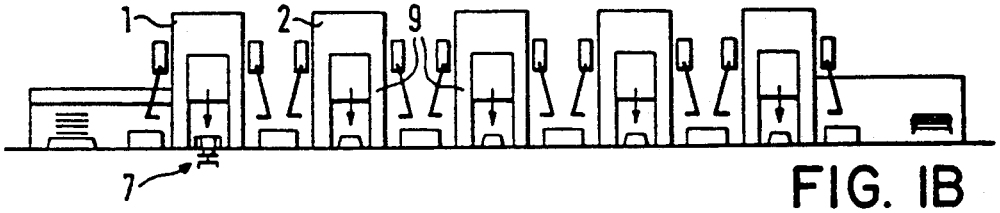
FIG. 1B
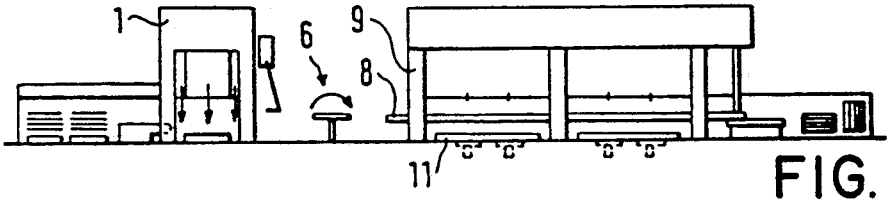
FIG. 1C
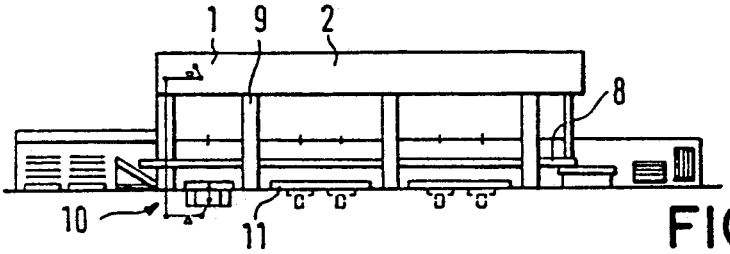
FIG. 1D
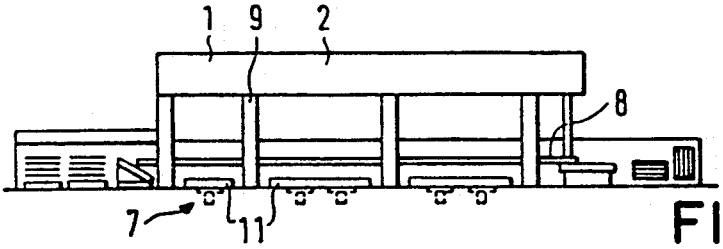
FIG. 1E
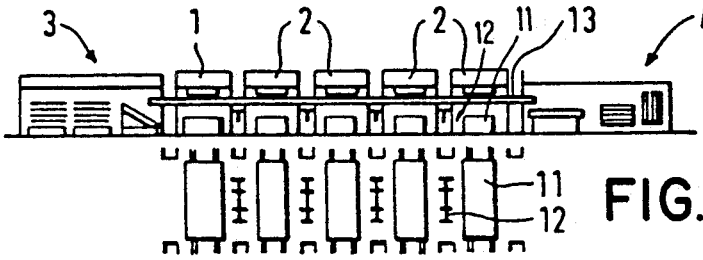
FIG. 1F
FIG. 1G

A

A

PRESS INSTALLATION HAVING SEVERAL PRESSES FOR THE WORKING OF SHEET-METAL PARTS

BACKGROUND AND SUMMARY OF THE INVENTION

The present invention generally relates to a press installation and more particularly to a press installation arrangement for minimizing transfer distances for sheet metal parts to be transferred between individual presses of the press installation.

Reference is made to the below listed related U.S. applications:

(i) U.S application Ser. No. 380,508, filed July 17, 1989, now abandoned based on German Application No. P 39 05 068.8 filed in Germany on Feb. 18, 1989; and (ii) U.S. application Ser. No. 413,607, filed Sept. 28, 1989, based on German Application No. P 39 05 073.4 filed in Germany on Feb. 18, 1989.

The working of sheet metal parts typically takes place in several working steps. Originally, individual presses, for example, so-called auto-body presses were used. When they were further developed into press trains, the working of the sheet metal parts first took place by a manual handling of the sheet-metal parts, and later by a partially mechanized and then by a fully automated conveying of the metal sheets.

The necessity for reducing investment and operating costs has led to a combining of working steps originally carried out on individual presses in press trains by utilizing compact, multistage multiframe transfer presses. Multiframe transfer presses meet the requirement of high flexibility, high output and short retooling times. For example, the eight working steps, which are required for the manufacturing of the sheet metal parts in automobile construction are distributed on one, two or three slides in the multiframe transfer presses.

As a result of the dimensions of the sheet metal parts, tool center distances of 2,500 mm and more are experienced, and the sheet metal parts and the devices for the transferring of the sheet metal parts in the working stages must be accelerated to a high speed in order to obtain high ejection rates in order to achieve large piece numbers for the transfer movements.

In German Patent Specification (DE-PS) 12 71 067 C, a press train is disclosed and in German Published, Examined Patent Application (DE-AS) 23 59 912 C2 a multiframe transfer press is disclosed. The disclosures of the above noted patents are discussed below.

The press train disclosed by (DE-PS) 12 71 067 C employs a multiple-action drawing press, which is operated continuously and is used as the head press, with a system for conveying sheet-metal parts through the press train which is controlled by the head press. In order to avoid turning devices between the head press and the press which follows and thus reduce the distances between the presses, the drawing press is equipped with a drawing slide operating in an upward direction and with a sheet holder slide operating in a downward direction.

The conveying system for the sheet-metal parts has a gripper rail system extending through the whole press train which can be moved along three axes for providing an opening and closing movement of the gripper rails, a lifting and lowering of a gripped work piece and a forward transfer and reverse movement of the gripper rails. Each press constitutes a separate machine. The use of gripper rails guided through the press train is useful only if the press slides of the individual presses also permit a synchronous transfer movement of the sheet metal parts. If the press train is to be operated in a fully synchronized manner, expensive synchronizing devices must be used for this purpose. Although the set-up of the individual presses has led to reduced space requirements, because of the elimination of the turning device and the resulting shorter distance between the presses, the low space requirement of multiframe transfer presses cannot be achieved. In addition, a relatively large press foundation is required, and the transfer step of the gripper rail system is also still relatively wide.

Moreover, the large mass of the conveying gripper rail system requires high driving forces at high acceleration values. Large-surface sheet metal parts as well as thin-walled sheet metal parts, i.e., all sheet metal parts which are unstable due to bending and the like, can be worked and transferred in the press train only to a limited extent, particularly if a high ejection rate (such as 16 parts per minute) is to be achieved. A tool change using sliding tables, for supporting tools, dies and the like which can be moved into and out of the presses, is not provided. Further, the linkage of rods for facilitating the movements of the gripper rail system along the three axes extends over the length of the press train, and the gripper rails interfere considerably with the changing operation of the tools of the slides.

(DE-AS) 23 59 912 CA discloses a transfer press having several working stations which follow one another. The transfer press is a multiframe transfer press having a headpiece, which is supported by frames, a press bed and slides, which can be lifted and lowered by a common drive. Tools or tool sets are assigned to the slides. In the area of the press frames, no-operation stages or so-called idle stages are provided in which intermediate depositing devices are arranged for receiving sheet metal parts. The drive of the two gripper rails along the three axes is taken from the main drive of the press or an auxiliary drive by means of cam control devices. Tools or tool sets and parts of the gripper rails can be exchanged using sliding tables which are moved into and out of the transfer press. The deforming and/or shearing forces differ in the individual working stages. However, the one-sided loading of the slides as well as the deflections of the slide, the table and the tool have a disadvantageous effect on the working and output capabilities of such a transfer press.

In order to avoid a breaking of the tool and the press, the working stages of each of the slides must be protected both individually and collectively. In the case of excessive pressure increases in the individual working stages and in the individual connecting rods, the transfer press must switch off, and therefore high expenditures are required for protecting the tools and the transfer press.

The tools or tool sets cannot be adjusted separately and must therefore first be adjusted to the working values. A change of the adjustment of one tool generally results in the change of all tools. As a result of the large center distance of the tools and thus of the large transfer movement of the sheet metal parts per slide stroke, the masses of the transfer rails must be accelerated and as a result, the output of the transfer press is low. High acceleration values and, in this case, the accelerations of large masses, result in vibrations in all parts of the press. The precision of the transfer and of the deforming of the workpieces is impaired. Also in the case of transfer presses, the transfer movement of the sheet metal parts corresponds to the center distance of the tools.

Accordingly, it is an object of the present invention, particularly in view of the increasingly large surfaces of the sheet metal parts to be transferred which are thin-walled and are therefore unstable, to significantly shorten the length of the transfer movement of the sheet metal parts per slide stroke, in order to thus reduce acceleration values.

In addition, it is a further object of the present invention to reduce the distance between the guides of each of the slides in order to improve the guiding ratio of the distance of the guides with respect to one another to the length of the guides and thus effect an improvement of the lateral guiding of each of the slides.

In addition, yet another object of the present invention is to assure that the elements of the device for the transfer of the sheet metal parts are lifted sufficiently far during tool changing times so that they do not impair the changing operation.

These and other objects are achieved by a hybbrid press installation which uses advantageous features of the press train and multiframe press discussed above.

In contrast to a press train and a multiframe transfer press, it is an advantage that the hybrid press installation, according to preferred embodiments of the present invention, has several presses, a single working stage being performed by each press so that a significantly smaller overall installation surface is required. On the whole, the conveying paths of the sheet metal parts are also reduced considerably. Further, the number of strokes and the output of the press installation may be increased. The press installation forms a system which is complete in itself and the working stages do not mutually influence one another as a result of the deforming operations. Moreover, the central control of all systems, such as the pressure consuming devices, the sequence of movements, the tool change and the like is advantageous in this case.

In comparison to a multiframe transfer press, the elimination of the mutual influencing of the working stages is advantageous as is the ability to protect each tool and thus of each slide by means of separate overload protection devices. Thus an improved overload protection is achieved. Each tool can be adjusted separately, and the reworking of these tools is significantly facilitated. The accessibility of the slides, of the tool tighteners, of the tools and of the part-receiving elements is also improved.

Additional advantages are the smaller masses and the lower space requirement of the sliding tables, the quieter conveying of the sheet metal parts, the active integration of intermediate depositing devices into the workpiece passage, including the provision to an inclined position for the arriving sheet metal parts and the providing of a new inclined position, and an easier construction of the press installation with an increased number of installation areas. Additionally, the static and dynamic loads on the foundation are reduced and more evenly distributed.

Other objects, advantages and novel features of the present invention will become apparent from the following detailed description of the invention when considered in conjunction with the accompanying drawings.

BRIEF DESCRIPTION OF THE DRAWINGS

FIGS. 1A to 1G schematically illustrate the development of the press train, by way of the multiframe transfer press, into the hybrid press installation according to one embodiment of the present invention;

DETAILED DESCRIPTION OF THE DRAWINGS

Figure 2:
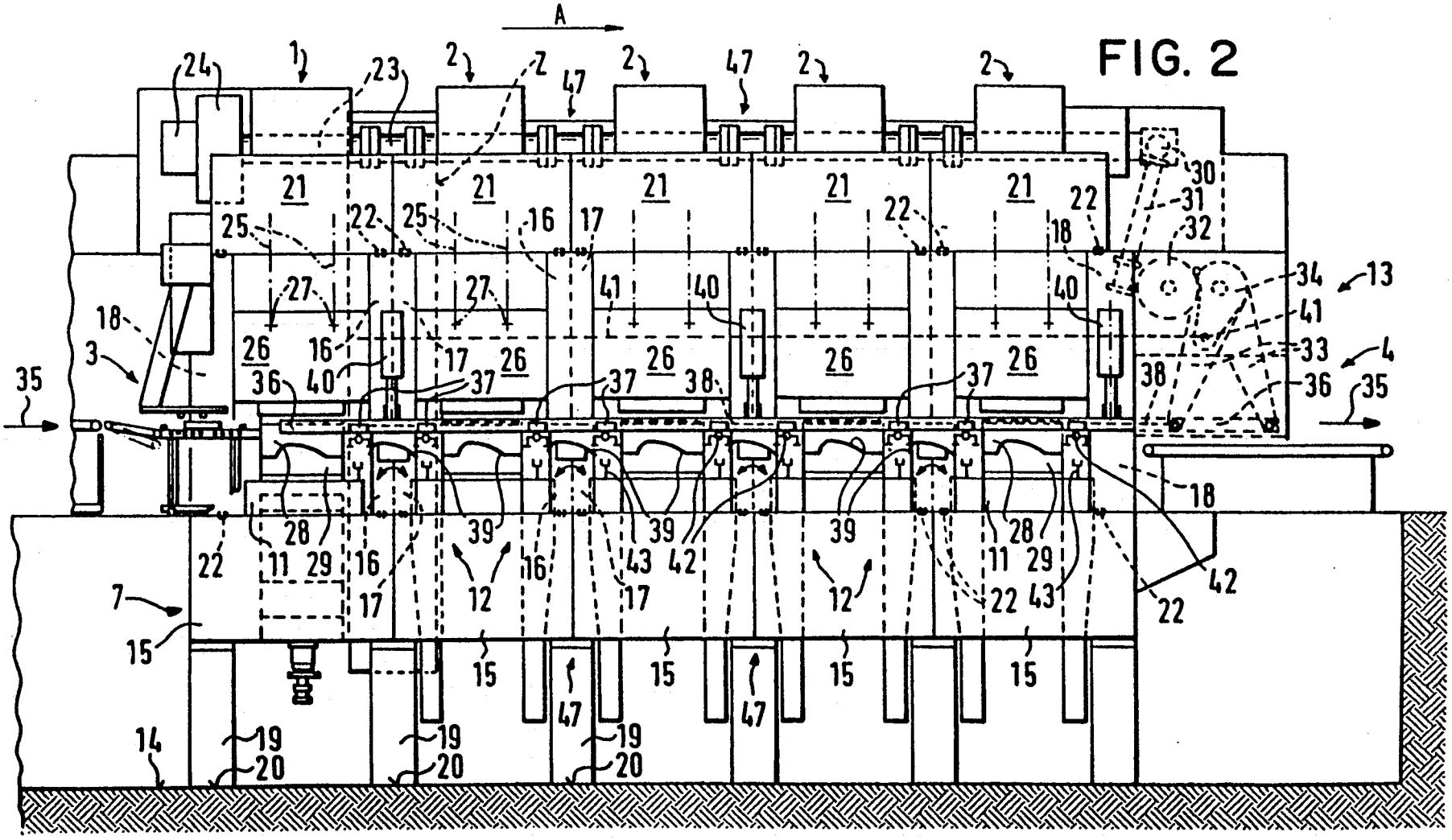
FIG. 2 is a front view of a hybrid press installation according to one embodiment of the present invention.

In FIGS. 1A to 1G, the same structural elements have the same reference numbers. FIG. 1A shows a press train with a head press 1 and additional transfer presses 2. The sheet metal part, which is fed by a feeding device 3 of the head press 1 is held at the head press 1 by a sheet holder slide in a drawing tool and is deformed by an additional slide. The movements of the slides for the holding and for the deforming take place in a downward direction. For the subsequent working of the sheet metal parts in the transfer presses 2, at least one turning device 6 is therefore required. The conveying of the sheet metal parts through the press train to the removal device 4 takes place utilizing feeders 5. The frames of the presses 1, 2 are indicated by the reference number 9.

By using a drawing apparatus 7 arranged in the press bed of the head press 1 as shown in FIG. 1B, with the die cushion operating in upward direction, the distance between the head press 1 and the transfer press 2 is reduced.

FIG. 1C shows a combined press installation with a double-acting drawing press 1, a turning device 6 and a three-frame transfer press 2 with frames 9 and a device 8 for transferring the workpieces through the working stages of the transfer press. The tool sets of, for example, two working stages respectively may be exchanged using sliding tables 11.

The four-frame transfer press shown in FIG. 1D, together with the double-acting head press 1, has a drawing stage 10 which operates in an upward direction, and a device 8 guided by the transfer press 2 for the transfer of the workpieces.

FIG. 1E shows the head press 1 as a single-acting press with a drawing apparatus 7 integrated into the press bed.

FIGS. 1F and 1G are simplified front and top views, respectively, of a hybrid press installation which, according to one embodiment of the invention comprises several presses, a single working stage being performed by each of the several presses, as explained in the following more detailed description with respect to FIGS. 2 to 5. Essential and new elements of the invention can be recognized in the schematic representation of FIGS. 1F and 1G. One intermediate depositing device 12 is arranged between each working stage, the intermediate depositing device 12 being one such as disclosed by U.S. Pat. No. 4,730,825, the entire disclosures of which is herein incorporated by reference. Each working stage may contain a tool for a sheet metal part to be worked or several tools for several sheet metal parts which are to be worked simultaneously in the working stage; however, preferrably a single working stage is performed by each of the several presses. The device 13 for the transfer of the workpieces is located above the sheet metal part conveying plane 35 as seen in FIG. 2, that is above the intermediate depositing devices 12.

Because the distance between each guide of the slides for the vertical bearing of the slide is determined by, among other things, the number of tools and working stages assigned to each slide, the tools or the forming stages clearly determines the size of the slides, the distance of the press frames from one another, and the distances of the guides of the slides. If, according to one embodiment of the present invention, each of the several presses perform only a single working stage and each slide receives a single tool or a single set of tools, in the case of a larger sheet metal part or a plurality of sheet metal parts to be worked simultaneously, as described below, the distance between frames of a press can be reduced even though larger sheet metal parts are being worked. Further, by providing an intermediate depositing device 12 between each press forming a working stage, the distance required by the transfer movement between a tool center (slide center) and the tool center (slide center) of a subsequent working stage is kept to a minimum. Moreover, in each working stage, the sheet metal part is deposited only once and removed only once.

Corresponding to FIG. 2, sheet metal parts 39 individually or, if, for example, both interior sides of passenger car doors are to be manufactured, two sheet metal parts 39', 39', as best seen in FIG. 3, are fed to the head press 1 by a feeding device 3. The sheet metal parts 39, are from about 1,750 to about 2,000 mm measured in the transfer direction. The corresponding transverse dimension ranges up to about 4,000 mm. The thickness of the parts 39 ranges between about 0.5 and 1.2 mm.

The head press 1 may be a drawing press with a drawing apparatus 7. The drawing press 1 has four frames, the left frame pair denoted by the reference number 18 and the right frame pair denoted by the reference number 16. The transfer presses 2, which are arranged behind the drawing press 1, are equipped with additional working sequences for the working of the sheet metal parts 39. The working, if necesssary, may also comprise redrawing stages. The transfer presses 2 also each have four frames comprised of two frame pairs 16, 17 and an end frame pair 18'.

The presses 1, 2 are installed next to one another with only a narrow spacing of the supporting areas of adjacent frame pairs 16, 17. The head pieces 21 of the presses 1, 2, by means of fitting pieces 22, are placed on the supporting bearing areas of the frame pairs 18, 16, 17, 18 and are held by means of turnbuckles 46, as best seen in FIGS. 3A, 3B, 4, 5A and 5B. Each press 1, 2 has a slide 26 which can be moved vertically by means of four connecting rods 25 respectively provided for each slide 26.

Figure 4:
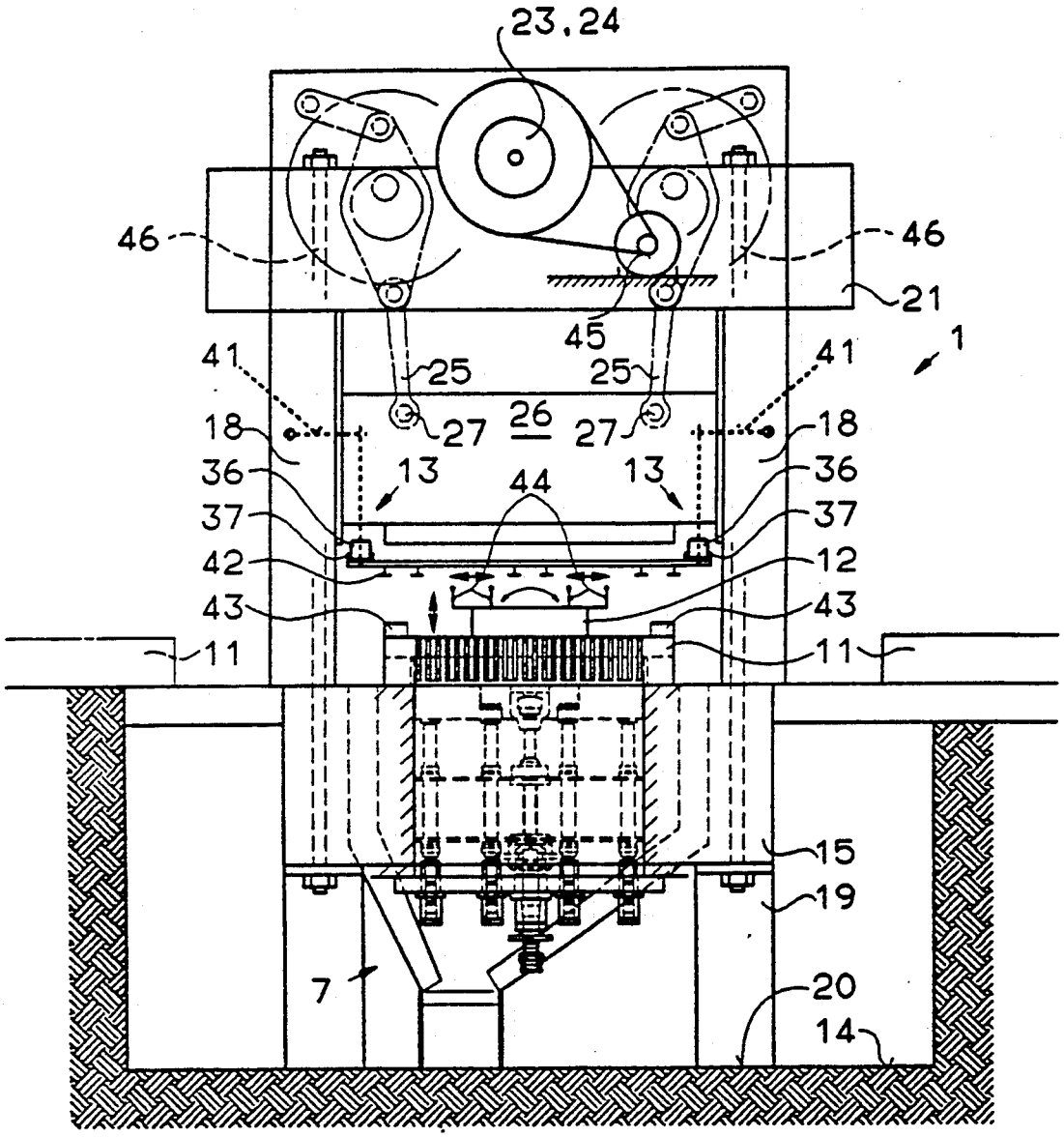
FIG. 4 is a lateral view of the hybrid press installation according to FIG. 2.

As shown in FIGS. 2 and 4, the connecting rods 25 of the drawing press 1 are applied to laterally spaced pressure points 27 at the slides 26. The connecting rods 25 are cam mechanisms or, as shown in FIG. 4, crankshaft mechanisms. The drive takes place via shaft 23, which extends over the length of the hybrid press installation and which is rotated by a main motor 45 as shown in FIG. 4. If necessary, drive takes place also by a second motor via a clutch/brake unit 24.

A press bed 15 is assigned to each press 1, 2, by which the frame pairs 18, 16 and 17, 18' or their supporting areas, are supported on supports 19. Between the press beds 15 and the frames 16 to 18', fitting pieces 22 are also inserted, in order to avoid lateral displacements in this case also. In order to avoid any mutual interferences, the head pieces 21 and the press beds 15 are also spaced at a narrow distance by gap 47 with respect to one another. The supports 19, which are common to each of the frame pairs 16 to 18', are installed on installation areas 20 of the foundation 14.

The gap 47 is provided to avoid mutual influencing of the head pieces 21 and of the frames 16–18' at the time of stress. The gap 47 ranges from about zero to about 50 mm wide, it being sufficient for the frame areas 16–18' and the head pieces 21 to be freely movable against one another (slide relative to adjacent element) when the hybrid press is stressed.

A sliding table 11 is assigned to each slide 26, by which the individual tools 28, 29 can be exchanged. An intermediate depositing device 12 is arranged, in each case, between two presses 1, 2 and 2, 2 with the working stages characterized and identified by the tools 28, 29 associated with each working stage. The intermediate depositing devices 12 are arranged, for example, at the center with respect to the center distances of the tools 28, 29 and between the frames 16, 17 as shown in FIG. 2 in order to cut in half the transfer movement of the sheet metal parts 39 per slide stroke.

For the transfer movement of the sheet metal parts 39, a transfer device, generally indicated by the reference number 13 is provide, the essential elements of which are located above the sheet metal part conveying plane 35. The transfer device 13, in this case, first consists of two moving rails 36, 36' which may extend from the feeding device 3 to the removal device 4 over the length of the hybrid press installation. A first moving rail 36, as seen in a view of FIG. 3, is disposed behind the slides 26 and the upper tool parts 28, and a second moving rail 36' is disposed in front of the slides 26 and the upper tool parts 28 so that they can be lifted and lowered at the presses 1, 2.

The lifting and lowering movements of the moving rails 36, 36' are achieved by lifting devices 40 which are mounted at frames 16 or 17 of the presses 1, 2 and which, for example, convert the horizontal adjusting movement of, in each case, one lifting linkage 41 guided in front of and behind the slides 26 to vertical movements for the moving rails 36, 36'. The lifting and lowering movements of the two moving rails 36, 36' take place synchronously and in time with the operation of hybrid press installation by movements transmitted from the shaft 23 by way of a transmission 30, a rotary shaft 31, an intermediate gear 32 and a cam tap to cam follower levers 34. Each of the lifting linkages 41 is operatively connected with the respective cam follower lever 34 by a suitable connection.

Carriages 37 can be moved along the longitudinal course of the moving rails 36, 36' on each of the parallel extending moving rails 36, 36'. In this case, oppositely disposed carriages 37 are connected with one another by suction bridges 42, as shown in detail in FIG. 3.

The moving drive of the carriages 37 towards and away from the direction A of the transfer movement takes place by conveying linkages 38 of cam follower levers 33, which are also moved by way of the transmission 30, the rotary shaft 31, the intermediate gear 32 and a cam tap. The two mentioned cam taps, in this case, are generated by the fact that the cam follower levers 33 and 34 rest against control cams 48 (FIG. 3) which are rotatably driven by way of the transmission 30, the transmission linkage 31 and the intermediate gear 32.

Figure 3A:
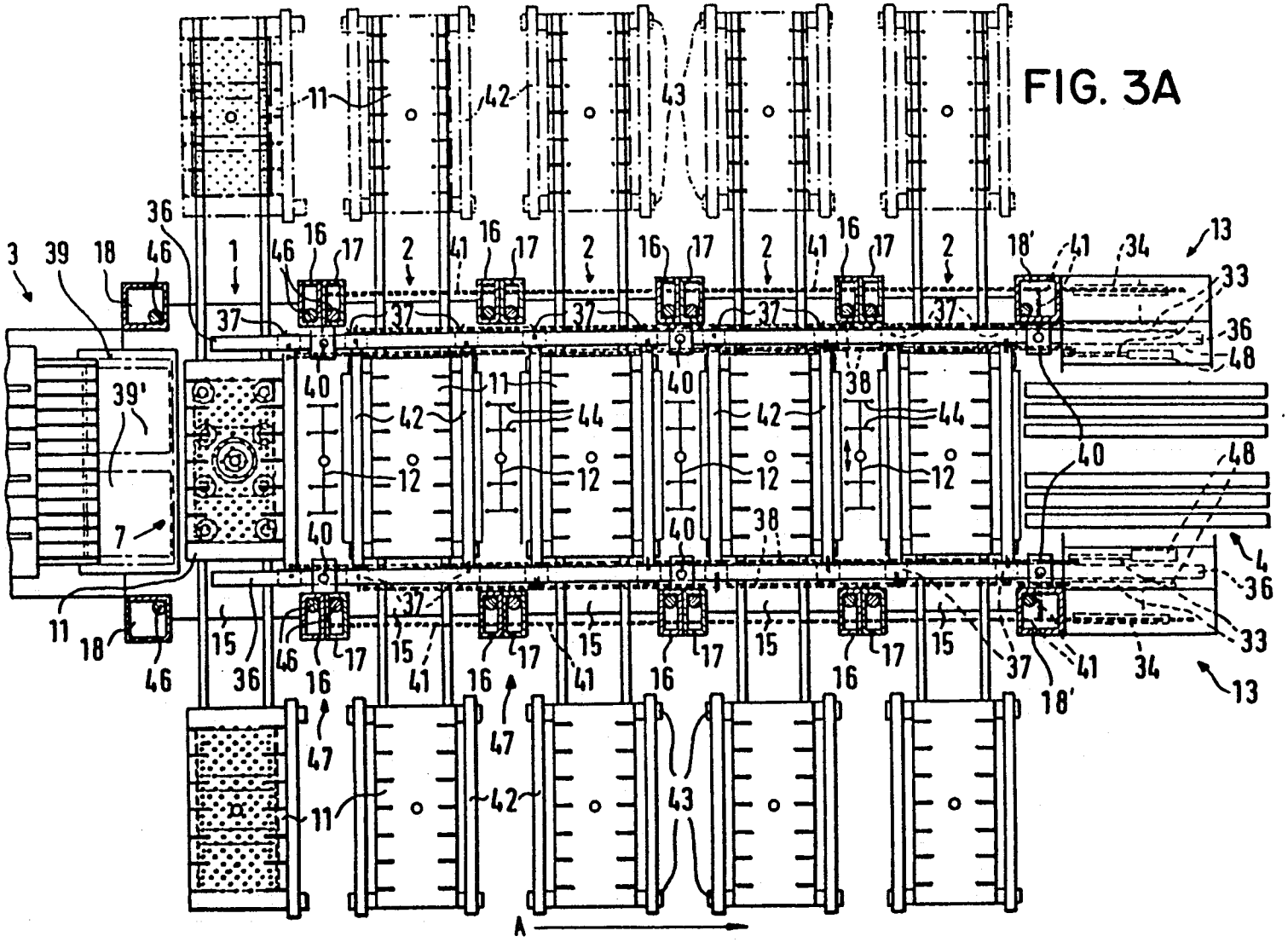
FIGS. 3A and 3B are top views of two different embodiments, respectively, of the hybrid press installation shown in FIG. 2, in which the head pieces are not shown.
Figure 3B:
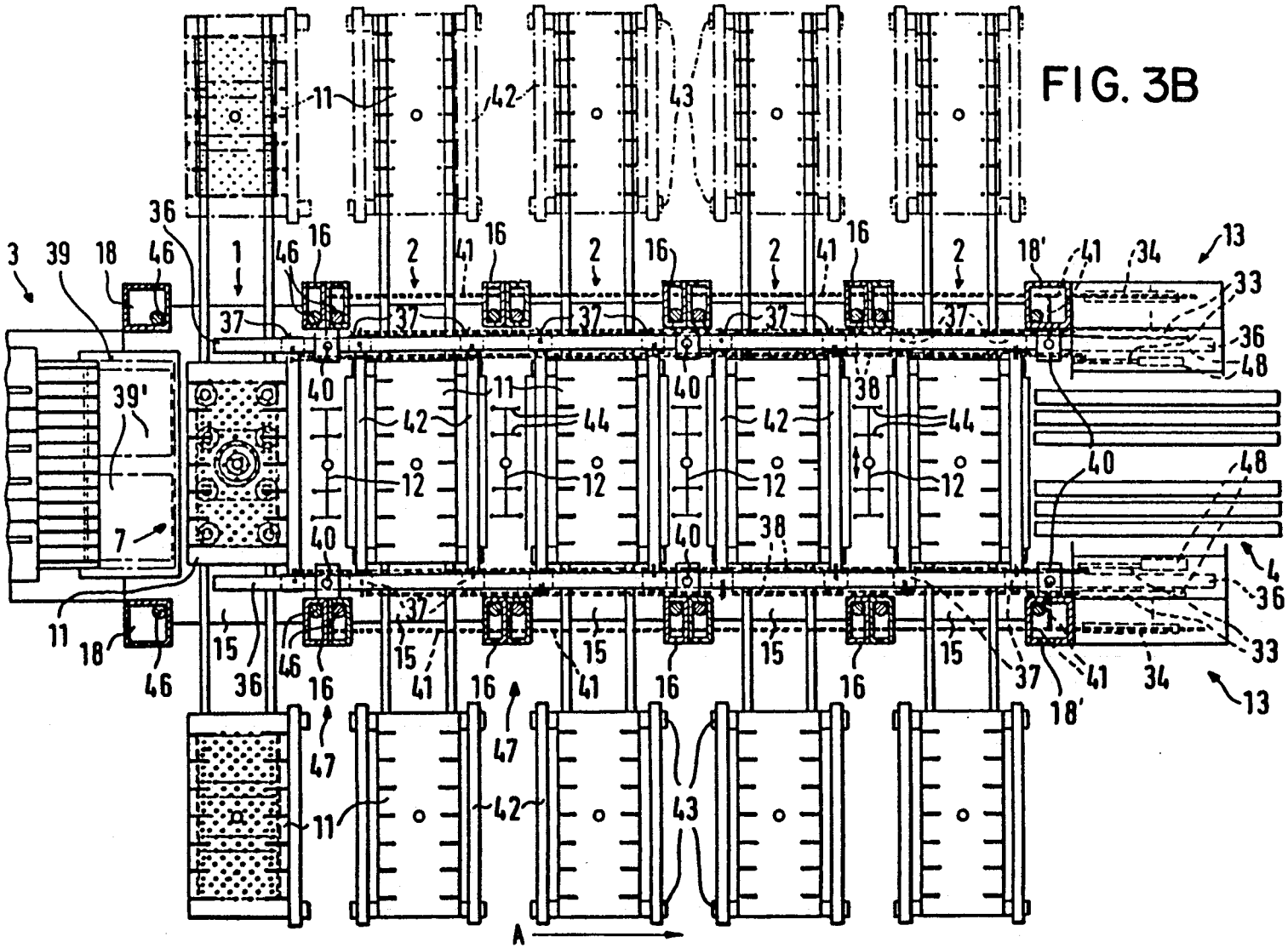

FIG. 3A and 3B correspond to the representation of a horizontal sectional view of the hydrid press installation above the sheet metal part conveying plane which, in FIG. 1, has the reference number 35.

In the feeding device 3 shown in FIG. 3A and 3B, metal sheets 39, 39' are shown which have varying sizes (and thicknesses). A large surface output sheet has the reference number 39 and two smaller output sheets have the reference number 39'. Correspondingly, one or two tools for each working stage must then be entered into the hybrid press installation depending on the type of metal sheet to be worked. For this purpose, one sliding table 11, respectively, is pushed into each press 1, 2 by way of rails to facilitate the installation of the appropriate tools. The tools, which are mounted on these sliding tables 11 and which, when the hybrid press installation is installed, can be exchanged when a new workpiece is to be made, are not shown. One tool or two tools consisting of an upper tool part 28 and a lower tool part 29 are assigned to each slide 26. The sliding tables 11 are located on both sides of the press installation so that as one sliding table 11 is moved out of the presses 1, 2 of the hybrid press installation with the removed tables (upward in the drawing), replacement tools are moved in from the other side of the hybrid press installation, by way of the sliding tables 11 shown in FIGS. 3A and 3B on the bottom.

The multipart construction of the frame pairs 16, 17 is illustrated in the sectional view afforded in FIG. 3A by the different shading directions of the frame pairs 16, 17. The multipart construction, in this case, refers to the bearing and supporting areas, but not to casing parts. The distance between the frame pairs 16, 17 or their bearing and supporting areas as well as the distance of the head pieces 21 and of the press tables 15 (FIG. 1) with respect to one another provided by the gap 47, is such that a mutual influencing of the individual presses 1, 2 due to vibration and the like is impossible.

In addition, the invention also contemplates embodiments wherein, for each two presses, which are placed adjacent one another, one frame 16, 17 or one frame pair 16, 17 respectively arranged at the front and rear of the two presses are used.

Figure 5A:
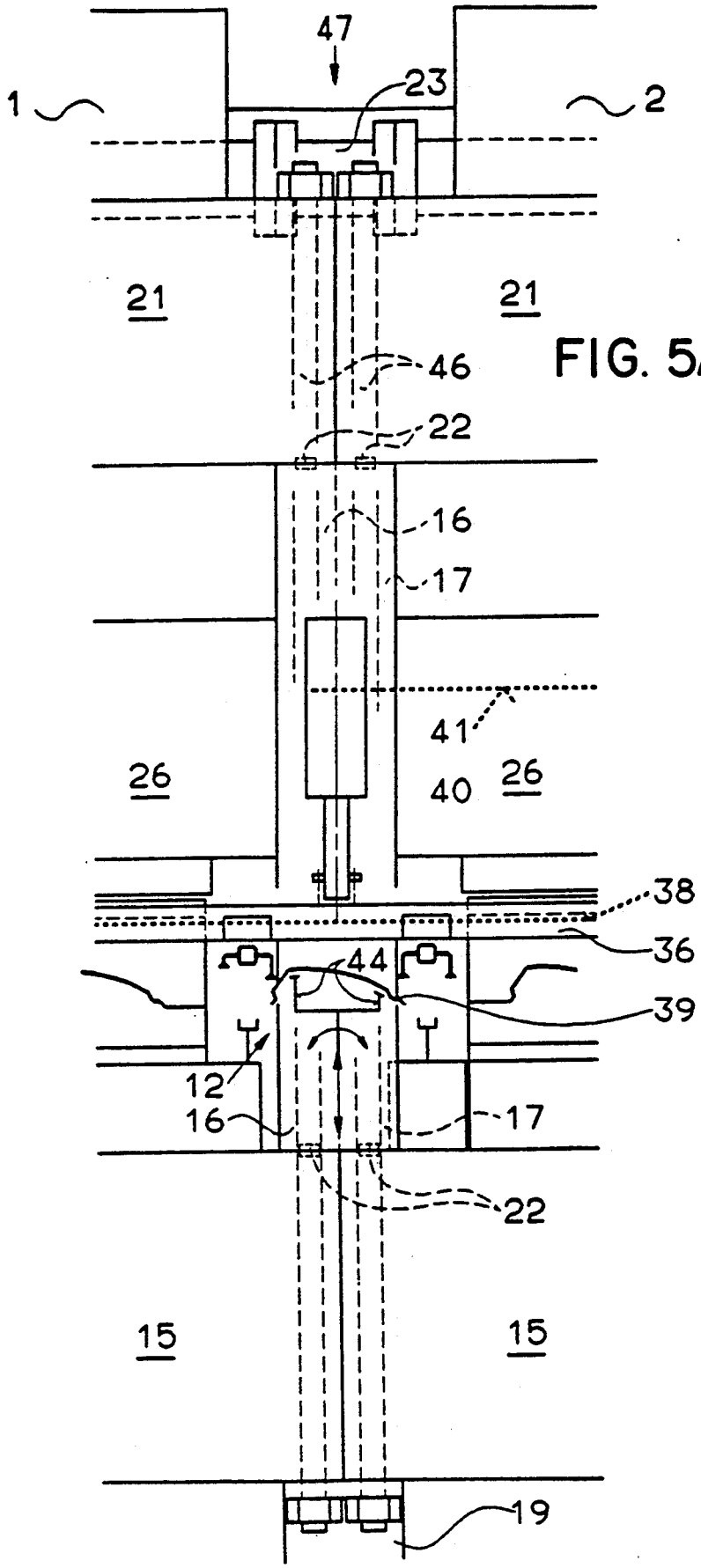
FIGS. 5A and 5B are an enlarged representation of detail Z shown in FIG. 2 of the two embodiments of FIGS. 3A and 3B, respectively.
Figure 5B:
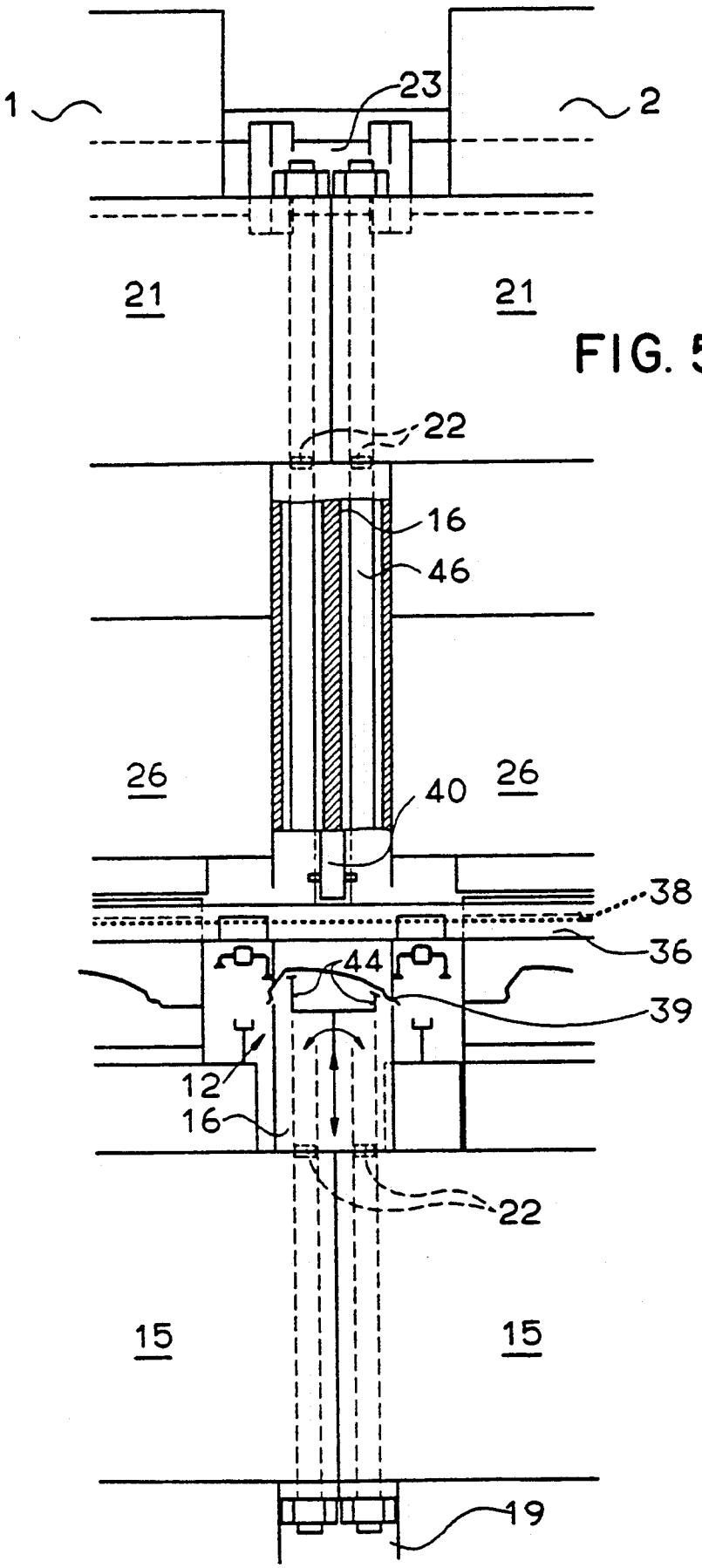

A one frame arrangement is also contemplated as illustrated in FIG. 3B wherein, within one frame 16 comprised of frame pairs 16, 17 supporting two head pieces 21 of adjacent presses 1, 2 and 2, 2, two turnbuckles 46 are provided as also seen in FIG. 5B, and two areas which each support an adjacent headpiece 21, specifically in the shape of sleeves with a centric turnbuckles 46 or one turnbuckle 46 which will then be eccentric. Such arrangements lead to a sigificant reduction, down to a negligible amount, of the mutual influencing of adjacent working stages. Sometimes an arrangement with a double arrangement of turnbuckles 46 and bearing supporting areas is also called a two-frame arrangement. When one head piece 21 and one press bed 15 respectively are used for each press 1, 2, these are indirectly connected with one another by means of the frame pairs 16 and 17.

In addition, it is possible to use one head piece 21, which is common to all presses 1, 2, as well as a single press bed 15.

Intermediate depositing devices 12 with sheet metal receiving devices 44 are positioned between the adjacent working stages. The upward-pointing sheet-metal part receiving devices 44, for supporting the sheet metal parts 39 from below, can be fully automatically adjusted by adjusting devices with respect to the height, the size, the shape and the inclined position of the sheet metal parts 39. The adjusting devices, the transmissions and the adjusting rods are not shown in detail.

The carriages 37, as shown in FIG. 3, as previously described with resPect to the conveying linkage 38 and the cam follower levers 33, can carry out different movements in connection with the lifting/lowering movements of the moving rails 36, in order to convey sheet metal parts 39 out of the tools 29 and into the intermediate storage devices 12 and at the same time convey sheet metal parts 39 from the intermediate storage devices 12 into the tools which follow downstream. During the deformation phase, the carriages 37 stay in the spaces between the tool and the slide of a press and the intermediate storage device 12. So that the carriages 37, in the individual moving stages, can also move through steps which have a varying width, the first, the third, the fifth and each next-plus-one carriage 37 can be moved by an interior conveying linkage 38, which is located between the sliding rails 36, 36' and the second, fourth and each next-plus-one carriage 37 can be moved by way of the exterior conveying linkage 38. Each conveying linkage 38, by means of a cam follower lever 33, is connected with control cams 48 moved by the shaft 23. The suction bridges 42, by means of an additional lowering movement of the moving rails 36, can be placed on supporting members 43 at the sliding tables 11 and can then subsequently be uncoupled from the carriages 37, in order to exchange these, at the same time, with the tools.

FIG. 4 illustrates the drive of the shaft 23 and slide 26 of the presses, in this case, of the drawing press 1. In the frame of the drawing press 1, a motor 45 is fixed which, by means of a V-belt and a centrifugal mass, rotates the shaft 23 via a clutch/brake unit 24. From this shaft 23, the movements of the slides 26 of the presses 1, 2, as well as the lifting and lowering movements of the moving rails 36 and the transfer movements of the carriages 37, are tapped in order to achieve a synchronization of the associated movements in this manner. The adjusting movements of the sheet metal receiving parts 44 are indicated by arrows. The reference number 13 indicates the transfer device for the sheet metal parts 39, with the lifting linkage 41 for the moving rails 36, 36' the carriage 37 and the suction beams 42 having outlined suction devices, such as vacuum holding devices. Reference number 46 indicates the turnbuckles between the head piece 21 and the press bed 15. The other reference numbers are used for purposes of orientation in the case of a comparison with FIGS. 2 and 3.

FIGS. 5A and 5B are provided for achieving a better understanding of the frame areas and of the supporting areas between two presses, for example, between presses 1 and 2 according to the two embodiments illustrated by FIGS. 3A and 3B respectively. The head pieces 21 are placed on frame pairs 16 and 17 using fitting pieces 22. The frame pairs 16, 17 are placed on the press beds 15 by means of additional fitting pieces 22. Each individual press 1, 2 is held by the turnbuckles 46. The press beds 15 are supported by supports 19. As mentioned previously, the head pieces 21 of adjacent presses 1, 2 or 2, 2 may also be placed on one frame pair 16, or 17, which will then be common to both of them, or on a single supporting area of one frame comprised of separate frame pairs 16, 17. In addition, frames 16, 17 may be supported directly by means of a support 19.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A press installation including several presses each forming a working stage for working of sheet metal parts, transfer means for feeding and removing of sheet metal parts and for the transferring sheet metal parts between the working stages and intermediate storage means for storing sheet metal parts at idle stages between working stages, the sheet metal parts being transferred along a conveying plane through the working stages, each of the presses having a slide for working the sheet metal parts which can be moved up and down by a drive means, a press bed and press frame means for supporting of head pieces of the several presses and a sliding table for facilitating a tool change which is assigned to each slide, wherein:

the several presses include additional transfer presses arranged behind a head press, the several presses being spaced at a narrow distance from one another;

the press frame means have supporting areas for separately supporting each of the head pieces of the several presses;

at least one tool is assigned to each of the slides, a single working stage being performed by each of the several presses;

one intermediate depositing means is arranged between two working stages;

synchronizing means are provided for coordinating movements of the slides and the transfer means from a common drive shaft; and the transfer means further includes holding means for holding sheet metal parts and shifting means, for moving the holding means, the holding means and the shifting means being guided above a sheet metal part conveying plane at the several presses.

2. A press installation according to claim 1, wherein the head press is a drawing press with a drawing apparatus operating from below and at least one of the transfer presses is equipped with a redrawing stage.

3. A press installation according to claim 1, wherein the transfer means for transferring the sheet metal parts extends through the press installation from an area of a feeding means at the head of the installation to an area of a removal means at the end of the installation and includes suspended conveying means.

4. A press installation according to claim 1, wherein frame means of adjacent presses, which are located opposite one another are placed next to one another on a common installation surface.

5. A press installation according to claim 4, wherein each of the several presses include a press bed which is supported on the common installation surface by additional supports.

6. A press installation according to claim 1, wherein at least three individual presses of the several presses, which include a drawing press that is first in working sequence, are placed next to one another, and the frame means of two presses which are opposite one another are supported on a common installation surface in parts.

7. A press installation according to claim 6, wherein the head pieces of adjacent presses are supported by frames means which are each common to both head pieces of adjacent presses.

8. A press installation according to claim 1, wherein sheet metal receiving means of the intermediate storage means are adjusted horizontally and vertically and with respect to an inclined position of the sheet metal parts.

9. A press installation according to claim 1 wherein, each slide, in at least two pressure points, is lifted and lowered by the driving means of the press installation.

10. A press installation according to claim 1, wherein synchronization of the movements of the slides of the several presses and of the movements of the transfer means for the transfer of the sheet metal parts in the working stages is facilitated by a common drive shaft, which, is connected at least with a main motor, the shaft being disposed in a head area of the press installation and extending over the length of the press installation.

11. A press installation according to claim 3, wherein the holding means have suction bridges which are fastened to carriage means, the carriages means, which are spaced from one another, being guided at moving rails, the moving rails 36 extending on opposite sides of the slides and tools in a longitudinal direction of the press installation and above the sheet metal part conveying plane, and the carriage means being movable in a longitudinal direction of the press installation, and the moving rails in a lifting and lowering direction, the carriage means and moving rails being movable in synchronization with the operation press installation.

12. A press installation including several presses each forming a working stage for working of sheet metal parts, transfer means for feeding and removing of sheet metal parts and for the transferring of the sheet metal parts between the working stages, and intermediate storage means for storing sheet metal parts at idle stages between working stages, each of the presses having a slide for working the sheet metal Parts which can be moved up and down by a drive means, a press bed and press frames for the supporting of head pieces of the several presses and a sliding table for facilitating a tool change which is assigned to the slide, wherein:

the several presses include additional transfer presses arranged behind a head press, the several presses being space at a slight distance from one another;

the press frame means have a common supporting area spaced above the press bed for supporting and connecting adjacent head pieces of adjacent press;

at least one tool assigned to each of the slides, a single working stage being performed by each of the several presses;

an intermediate depositing means arranged between two working stages;

synchronizing means for coordinating movements of the slides and transfer means from a common drive shaft; and the transfer means including holding means for holding the sheet metal parts and shifting means for moving the holding means, the holding means and the shifting means being guided above a sheet metal conveying plane at the several presses.

13. A press installation according to claim 12, wherein the head press is a drawing press with a drawing apparatus operating from below and at least one of the transfer presses is equipped with a redrawing stage.

14. A press installation according to claim 12, wherein the transfer means device for transferring the sheet metal parts extends through the press installation from an area of a feeding means at the head of a the installation to an area of a removal means at the end of the installation, and includes suspended conveying means.

15. A press installation according to claim 12, wherein sheet metal receiving means of the intermediate storage means are adjusted horizontally and vertically and with respect to an inclined position of the sheet metal parts.

16. A press installation according to claim 12, wherein, each slide, in at least two pressure points, is lifted and lowered by the driving means of the press installation.

17. A press installation according to claim 12, wherein synchronization of the movements of the slides of the several presses and of the movements of the transfer means for the transfer of the sheet metal parts in the working stages is facilitated by a common drive shaft, which, is connected at least with a main motor, the shaft being disposed in a head area of the press installation and extending over the length of the press installation.

18. A press installation according to claim 14, wherein the holding means have suction bridges which are fastened to carriage means, the carriages means, which are spaced from one another, being guided at moving rails, the moving rails extending on opposite sides of the slides and tools in a longitudinal direction of the press installation and above the sheet metal part conveying plane , and the carriage means being movable in a longitudinal direction of the press installation, and the moving rails in a lifting and lowering direction, the carriage means and moving rails being movable in synchronization with the operation press installation.

* * * * *